US011112206B1

(12) United States Patent
Jones

(10) Patent No.: US 11,112,206 B1
(45) Date of Patent: Sep. 7, 2021

(54) ARCHERY RELEASE

(71) Applicant: H.I.T. Outdoors, LLC, Clay City, KY (US)

(72) Inventor: Brian K. Jones, Georgetown, KY (US)

(73) Assignee: H.I.T. Outdoors, LLC, Clay City, KY (US)

( * ) Notice: Subject to any disclaimer, the term of this patent is extended or adjusted under 35 U.S.C. 154(b) by 0 days.

(21) Appl. No.: 17/102,935

(22) Filed: Nov. 24, 2020

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS

| | | | |
|---|---|---|---|
| X228302 | | 6/1880 | Beard |
| X229089 | | 6/1880 | Bumham |
| 3,853,111 | A | 12/1974 | Stanislawski et al. |
| 3,965,884 | A | 6/1976 | Killian |
| 4,036,204 | A | 7/1977 | Scott |
| 4,041,926 | A | 8/1977 | Troncoso et al. |
| 4,160,437 | A | 7/1979 | Fletcher |
| 4,509,497 | A | 4/1985 | Garvison |
| 4,539,968 | A | 9/1985 | Garvison |
| 4,567,875 | A | 2/1986 | Fletcher |
| 4,574,767 | A | 3/1986 | Gazzara |
| 4,620,523 | A | 11/1986 | Peck |
| 4,674,469 | A | 6/1987 | Peck |
| 4,854,293 | A | 8/1989 | Roberts |
| 4,881,516 | A | 11/1989 | Peck |
| 5,009,214 | A | 4/1991 | Wilde |
| 5,025,772 | A | 6/1991 | Stevenson |
| 5,205,268 | A | 4/1993 | Savage |
| 5,261,581 | A | 11/1993 | Harden |
| 5,273,021 | A | 12/1993 | Tepper |
| 5,323,754 | A | 6/1994 | Pittman et al. |
| 5,448,983 | A | 9/1995 | Scott |
| 5,546,924 | A | 8/1996 | Todd |

(Continued)

OTHER PUBLICATIONS

Various prior art releases (1) downloaded from http://www.archeryhistory.com/releases/releasespics/release4.jpg on Dec. 29, 2009.

(Continued)

*Primary Examiner* — John A Ricci
(74) *Attorney, Agent, or Firm* — Warner Norcross + Judd LLP

(57) ABSTRACT

An archery release is provided in the form of a back tension archery release having an adjustable pawl which includes a paddle that can be selectively engaged by an adjuster element, for example a fastener, to set a release point of the release. The pawl can be selectively rotatable about a pivot axis by engaging the adjuster element against a surface of the paddle, which paddle can project away from the pivot axis a first distance to provide a lever that the adjuster element can act against. The release can include a second adjuster element opposing the first and engaging an opposite side of the paddle to cooperate with the other one and further secure the paddle and thus the pawl in a fixed location to set the release point.

20 Claims, 4 Drawing Sheets

(56) References Cited

U.S. PATENT DOCUMENTS

| | | | | |
|---|---|---|---|---|
| 5,595,167 | A | 1/1997 | Scott | |
| 5,596,977 | A | 1/1997 | Scott | |
| 5,685,286 | A | 11/1997 | Summers | |
| 5,694,915 | A | 12/1997 | Summers | |
| 5,765,536 | A | 6/1998 | Scott | |
| 5,803,068 | A | 9/1998 | Summers | |
| 5,850,825 | A | 12/1998 | Scott | |
| 5,937,842 | A | 8/1999 | Summers et al. | |
| 6,032,661 | A | 3/2000 | Goff et al. | |
| 6,571,786 | B2 | 6/2003 | Summers et al. | |
| 6,631,709 | B2 | 10/2003 | Carter et al. | |
| 6,736,124 | B2 | 5/2004 | Carter | |
| 6,895,951 | B2 | 5/2005 | Summers et al. | |
| 6,945,241 | B2 | 9/2005 | Pellerite | |
| 6,953,035 | B1 | 10/2005 | Summers et al. | |
| 7,654,254 | B1 | 2/2010 | Rentz et al. | |
| 8,622,051 | B2 | 1/2014 | Summers et al. | |
| 9,027,540 | B2 * | 5/2015 | Springer | F41B 5/1469 124/35.2 |
| 10,436,544 | B1 | 10/2019 | Jones | |
| 2004/0079351 | A1 | 4/2004 | Summers et al. | |
| 2009/0090342 | A1 | 4/2009 | Freitag et al. | |
| 2009/0095270 | A1 | 4/2009 | Graves | |
| 2010/0108047 | A1 | 5/2010 | Jones | |
| 2011/0168146 | A1 | 7/2011 | Deceuster | |
| 2012/0192844 | A1 | 8/2012 | Springer | |
| 2012/0285431 | A1 | 11/2012 | Summers et al. | |
| 2013/0025578 | A1 | 1/2013 | Jones | |

OTHER PUBLICATIONS

Various prior art releases (2) downloaded from http://www.archeryhistory.com/releases/releasespics/release4.jpg on Dec. 29, 2009.

Prior art releases (3) downloaded from http://www.archeryhistory.com/releases on Jul. 21, 2011.

Prior art releases (4) downloaded from http://www.archeryhistory.com/releases on Jul. 21, 2011.

Longhorn Hunter (Jan. 2010).

* cited by examiner

ARCHERY RELEASE

BACKGROUND OF THE INVENTION

The present invention relates to an archery release aid, and more particularly to a back tension archery release.

Conventional archery releases temporarily hold a bowstring of an archery bow so that an archer can pull on the release and subsequently draw the bowstring to ready an arrow for shooting from the bow. In general, archery releases are intended to consistently release the bowstring when the archer shoots the arrow, and thus increase the accuracy of the shot.

A common type of release used by some archers, and in particular competitive archers, is referred to as a back tension release. This release includes a release handle, a release head bracket pivotally joined with the handle and a hook pivotally secured to the release head bracket. The hook engages and holds the bowstring, and is configured to engage a pawl.

To operate the release so that it releases a bowstring held in the hook, an archer holds the handle, and concentrates to squeeze together their shoulder blades, effectively tensing their back muscles. Because the archer holds the device in their hand, the movement of the back muscles while tensing those muscles moves the archer's hand, and in turn, rotates the release slightly. This slight rotation moves the release enough so that the hook disengages the pawl, and thereby becomes free to move and release the bowstring.

Back tension releases are highly effective at eliminating shot anticipation, which may hinder shot accuracy, because they release the bowstring somewhat unexpectedly. This typically improves shooting form and shot placement and thereby increases the accuracy of an archer using the back tension release.

Archers usually have preferences with regard to the amount of back movement necessary to actuate the release and thereby release the hook and bowstring held by that hook. Most back tension releases have a moon shaped pawl secured to the handle upon which part of the hook moves. The moon shaped pawl typically is mounted to the release via an axle, and held in a fixed orientation relative to the handle during a shot sequence, but can be selectively adjusted to alter its last point of engagement with the hook, thus changing the release point and sensitivity of the release relative to an archer's movement of their back muscles.

To provide the above adjustability so an archer can customize the release point and sensitivity of the moon pawl, many releases include a long screw that extends through the handle and generally directly toward the axle. A tip of the screw abuts a rounded surface on the pawl to hold the pawl in a fixed positon. The archer can loosen that long screw, which in turn disengages the pawl. The archer can then pivot the pawl about the axle, which thereby moves the point of engagement with the hook. The archer can tighten the long screw again, carefully holding the pawl in place with their fingers. The screw tip moves generally radially toward the axle, until it sufficiently engages the rounded surface, thereby fixing the pawl in place to set the release point for the hook.

With conventional releases, where the screw and its tip point radially at the axle and engage a rounded surface of the pawl, that tip sometimes can disengage and slide relative to the rounded surface if loosened slightly, which might not be perceived readily by the archer. Some manufacturers try to address this and further secure the moon shaped pawl by including another screw that is generally parallel to the axle, but displaced from it. That secondary screw can press against a lateral side surface of the moon pawl, again in a direction parallel to a length of the axle. While this works, it can sometimes add complexity to the release.

Accordingly, there remains room for improvement in connection with back tension releases and their components.

SUMMARY OF THE INVENTION

An archery release is provided in the form of a back tension archery release including an adjustable pawl having an adjuster paddle that is selectively engaged by one or more adjuster elements to secure the pawl in a fixed position for a customized release of a hook sear that engages the pawl.

In one embodiment, the adjustable pawl can be configured to include an engagement surface that selectively engages a hook sear. The hook sear can include a sear edge that slidably engages the engagement surface until the sear edge passes a pawl edge whereupon the hook sear disengages the pawl, and thereby releases a bowstring held by the hook sear.

In another embodiment, the adjuster paddle can include a first contact surface and an opposing second contact surface. The first adjuster element can directly engage the first contact surface and exert a force vector against that paddle to secure the pawl in a fixed position.

In still another embodiment, the first adjuster element can be a threaded fastener having an axis that is transverse to the pivot axis of the pawl. The fastener axis can be perpendicular to the pivot axis of the pawl in some cases, and can extend a distance under or below the pivot axis.

In yet another embodiment, the release can include a second adjuster element. The first adjuster element and second adjuster element can be disposed on opposite sides of the adjuster paddle of the pawl, and can exert opposing force vectors against the adjuster paddle of the pawl. These force vectors can cancel each other out, and can thereby hold the pawl in a fixed rotational positon to set the release point of the release.

In even another embodiment, the arm can define a paddle recess within which the adjuster paddle is selectively movably disposed. The recess can be defined between a first wall and a second wall below the pivot axis, and can extend downwardly below the axis. The first wall can define a first threaded hole and the second wall can define a second threaded hole. These holes can lay along a common axis that intersects the adjuster paddle in the recess of the arm. The threaded holes can receive the adjuster elements, which can be in the form of threaded fasteners.

In a further embodiment, the archery release can include a release body having a handle, configured to engage an archer's digits, and an arm extending toward and joined with a release head, which can include a hood and a release hook. The arm can be configured to be placed between the archer's digits, and can connect the head and the remainder of the handle. Optionally, the handle can be substantially solid throughout, without any internal voids to accommodate moveable adjusters, except for the recess within which the adjuster paddle is located.

A simple and efficient archery release is provided that enables an archer to precisely and consistently adjust the release point of the release. With the adjustable pawl, the archer also can avoid the complexity and difficulty in adjusting the pawl, rather, a simple turn of an adjuster element can precisely adjust the position and spatial orientation of the pawl relative to the arm of the release, and thereby set the location of the pawl edge for the release point. The use of two or more adjuster elements can further quickly secure the precise position of the pawl in the arm and set the release point solidly.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
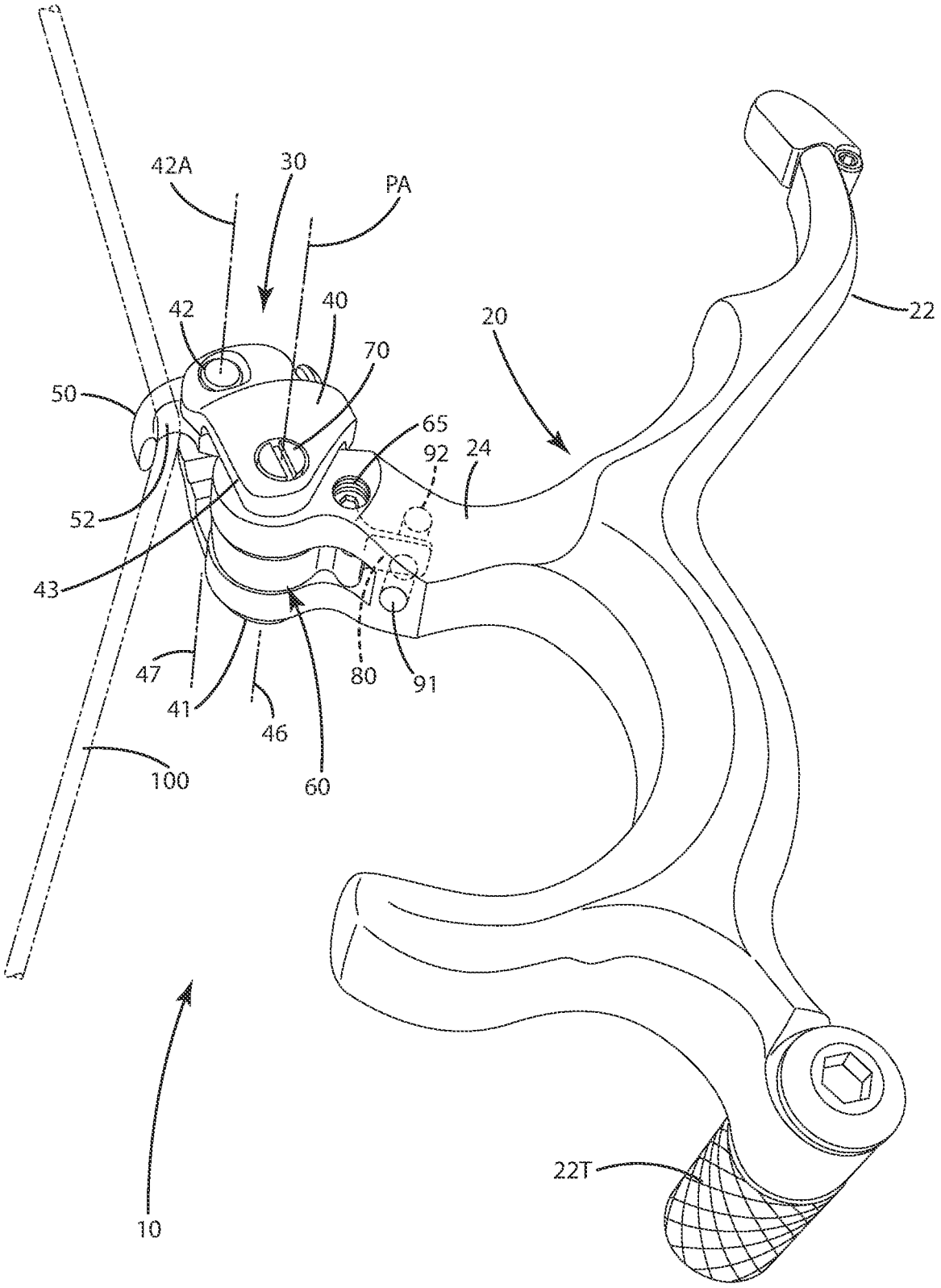
FIG. 1 is an upper perspective view of the archery release of a current embodiment engaged with a bowstring.

A current embodiment of the archery release is shown in FIGS. 1-4 and generally designated 10. The release 10 is shown in the form of a back tension release, however, the current embodiment can be utilized with a variety of different types of releases, for example, plunger releases, thumb releases, pinky releases, rope releases, and other types of handheld releases modified as described herein to be tethered to a wrist strap. The back tension release 10 shown in the figures includes a release body 20 joined with a release head 30, which can include a hood 40, a hook or sear 50 and a pawl 60.

The pawl 60 can be precisely adjustable with features as described below to set a release point of the release. One or more fasteners 65, 68 joined with an arm 24, or ears 24A and 24B of the arm, can have ends or tips that selectively engage lateral surfaces of the pawl to aid in preventing rotation of the pawl; however, with the particular pawl and adjuster elements described below, these fasteners can be deleted. The release 10 can include a locking axle pin or axle 70 that threads into ears 24A and 24B to hold the ears a fixed distance from one another, while the ends of that axle can allow the hood to freely rotate about them with the sear attached to the hood. The axle and associated pawl 60 can have a pivot axis PA about which the pawl 60 can be selectively rotated as described below. The arm 24 can extend between an archer's digits, and can be void of any internal holes therein that might promote weakness of the arm.

The release can be used to assist the archer in drawing and releasing the bowstring 101. When the release 10, as shown in FIG. 1, is used to draw the bowstring 100, the bowstring 100 is captured by the sear in a bowstring notch 52. As the archer draws the bowstring, the hook or sear 50 remains engaged with the bowstring 100. After being drawn, the archer moves or rotates the handle to rotate about the pivot axis PA, which can be aligned with the first axle 70, in direction R by tensing the archer's back muscles, which translates to pulling on the first handle portion 22. When such movement occurs, the sear edge 54 moves relative to, for example, slides along, the pawl engagement surface 66 until the sear edge 54 moves beyond the pawl edge 64 such that the sear 50 no longer engages the pawl. Upon such a disengagement, the sear 50 is free to rotate, and thus release the bowstring 100 from the bowstring notch 52 of the sear, thereby shooting the bow with which the release is used.

As used herein, bowstring refers to an actual bowstring of an archery bow and any device or component adapted to join with a bowstring of an archery bow and aid an archer in drawing or releasing the bowstring, including rope loops, which are attached to the bowstring above and below the location where an arrow nock rests, and receivers, for example, a metal loop or partial loop that is joined with the bowstring above and below, or only above, or only below the location where the arrow nock rests on the bowstring. Further, as used herein archery bow refers to any compound bow, recurve bow, long bow, crossbow or any other device that propels or is capable of propelling an arrow, bolt or other similar projectile.

Referring to FIGS. 1-4 the components of the release 10 will now be described in more detail. The release 10 can include a release body 20, which can include a handle 22. Optionally, the handle can define multiple grooves or recesses designed to accommodate one or more digits of a user. Further optionally, the handle can be a straight bar or other suitable gripping structure to enable a user to grasp the release body 20. Yet further optionally, the handle can be in the form of a loop, such as a thumb or digit ring, with or without further extensions for other digits. The arm itself can be integrated into the handle, forming a portion of the handle.

Figure 2:
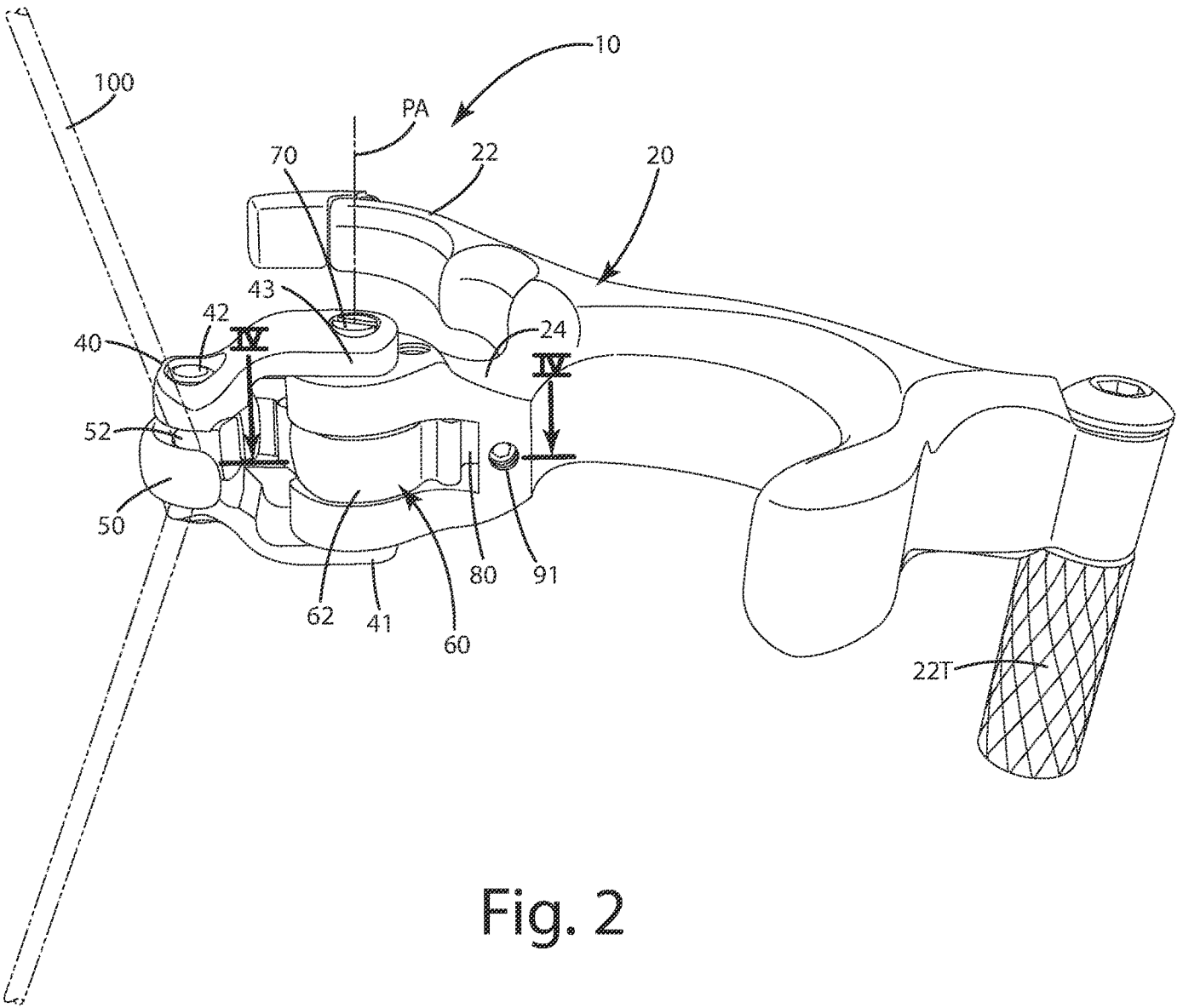
FIG. 2 is a perspective side view of the archery release engaging the bowstring.

As shown in FIGS. 1-2, an arm 24 can extend toward the release head 30 from the handle 22. The arm 24 can be an integral or separate from the handle 22 and remainder of the body 20. The handle 22 can be configured to engage certain digits on a user's hand. The arm 24 can be configured to extend and fit between a user's digits when the handle is held in the user's hand. Optionally, the handle 22 can include an extension 22C to which a thumb peg 22T is joined. This thumb peg can be held and/or actuated by an archer's thumb during a draw cycle.

The arm 24 can transition to a first ear 24A and a second ear 24B. These first and second ears can be separated by a gap G. The ears can extend outward away from the arm 24 and can themselves define holes, as described below, unlike the arm part which is configured to extend between digits of an archer's hand, and which does not include any internal voids or holes therein, except for the recess 26 described below. Optionally, each of the ears can be threaded and configured to receive respective fasteners 65 and 68 therein. These fasteners can be set screws and can be threaded to threadably engage the respective holes. These set screws 65 and 68 can extend through the respective ears and can engage the first and second lateral sides of the pawl so as to assist in holding the pawl in a fixed position relative to the ears and the arm, thereby setting the release and position of the pawl edge as describe below. Optionally, the set screws can be disposed in the holes so that no portion thereof extends outward from the exterior surfaces of the respective ears.

Figure 4:
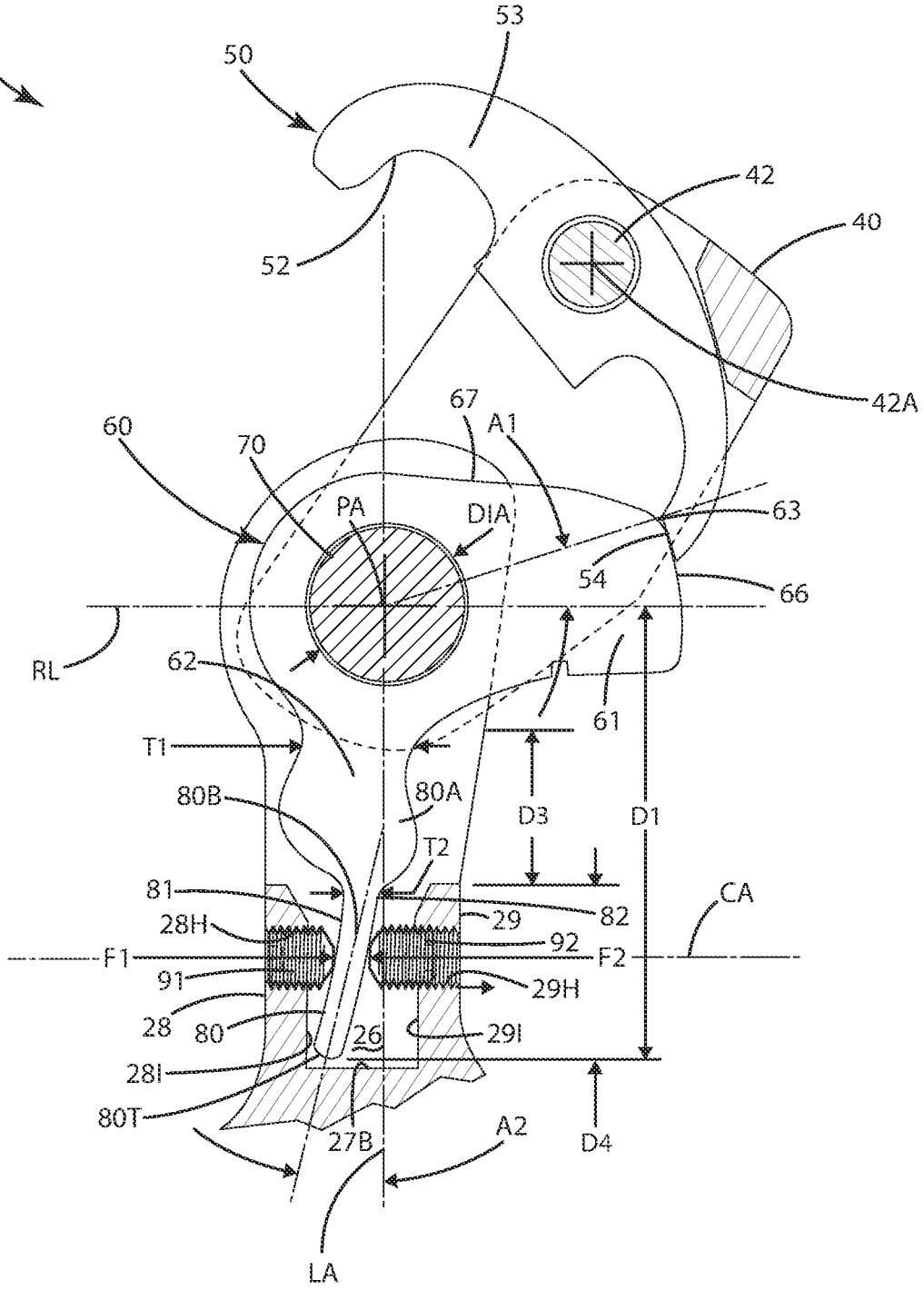
FIG. 4 is a section view of the adjuster elements engaging an adjuster paddle to selectively set a release point or other positon of the pawl.

Further optionally, the arm 24 can be constructed so that it is substantially solid and without any internal voids, except for the recess 26. As shown in FIG. 4, the recess 26 can be sized and shaped to receive the adjuster paddle 80 of the pawl. The recess can be formed and bounded by a first wall 28 and a second wall 29, as well as a bottom wall 27B, which all can be parts of the arm 24. The first and second walls can be located below the pivot axis PA and the axle 70. The first and second walls can include respective inner surfaces 28I and 29I that face toward one another and toward the adjuster paddle 80 when it is disposed in the recess 26. Optionally, the adjuster paddle 80 does not engage or contact either of these walls or their inner surfaces.

The first wall 28 can define a first threaded hole 28H and the second wall 29 can define a second threaded hole 29H. Optionally, the first and second threaded holes can lay along a common axis CA that intersects the adjuster paddle 80 when the adjuster paddle is located in the recess of the arm. Sometimes, the first and second threaded holes can be offset from one another, not laying along a common axis, and in some cases, laying along axes that are transverse and/or angled relative to one another.

Figure 3:
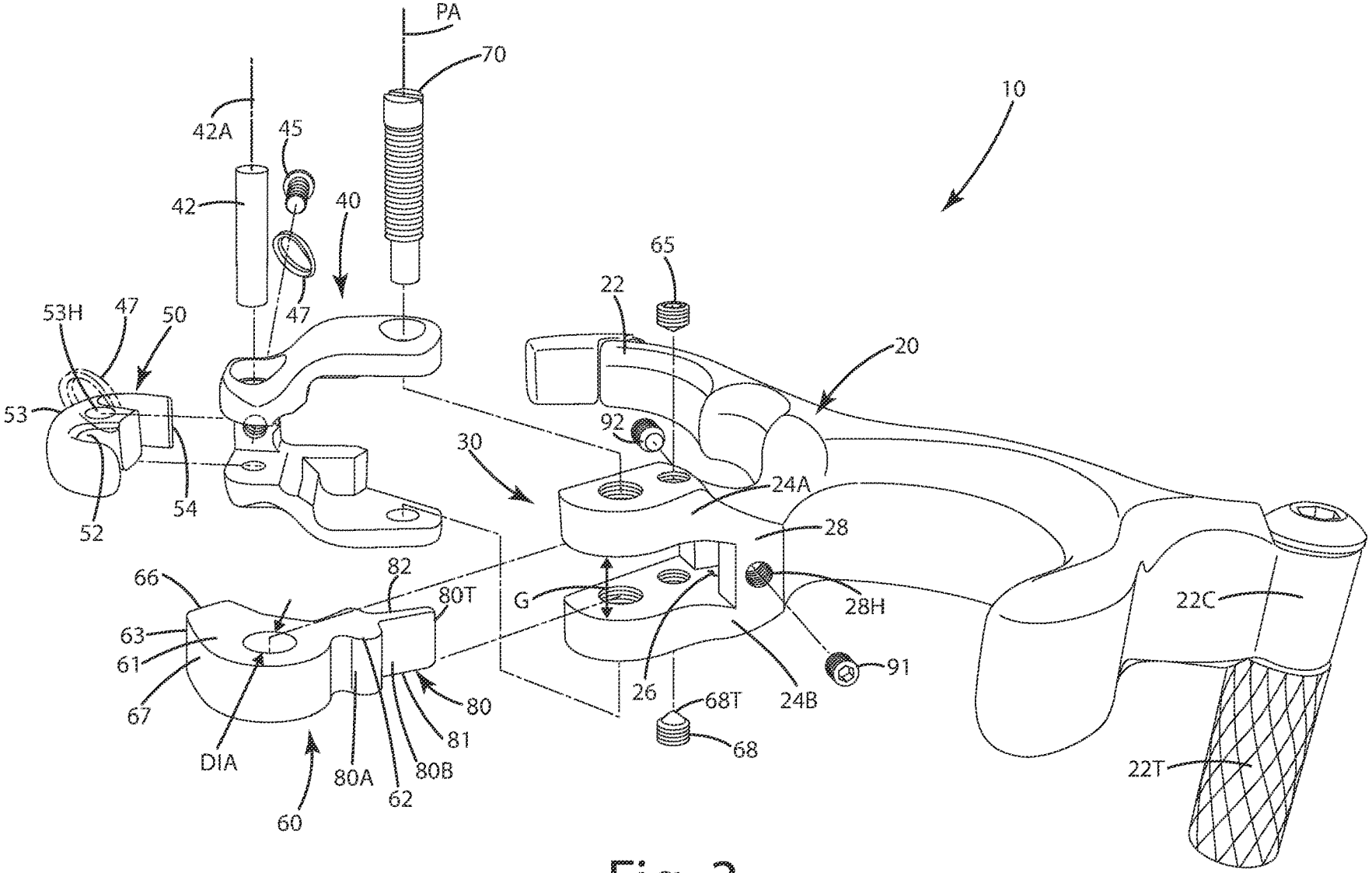
FIG. 3 is a perspective exploded side view of the archery release.

As shown in FIGS. 1-3, the arm can generally join the release head 30 and a hood 40 to the handle 22. The hood 40 can be in the form of a channel-shaped member, including opposing sidewalls 41 and 43. These sidewalls can generally straddle an end of the release arm 24 and/or release body 20. The hood 40 can be secured via the axle 70 to the arm and its ears, and can freely rotate about the axle 70, for example, about the pivot axis PA. At the opposite end of the hood 40, a hook or sear 50 can be rotatably mounted to a sear axle 42 so that the hook sear 50 can rotate about the sear axis 42A. The hook sear 50 can define a bowstring notch 52 which directly engages the bowstring of an archery bow. This bowstring notch 52 can transition to a sear body 53. The bowstring notch can include a curvilinear, planar or other smooth surface configured to minimize wear on a bowstring. The bowstring notch can be a U or V shaped opening or recess configured to capture at least a portion of the bowstring. The sear 50 can be selectively tensioned or biased to a preselected configuration with a rubber band or other biasing element 47 held by a pin or fastener 45.

As mentioned above, the pawl 60 can be attached to the arm 24 and the release body 20 with an axle or pin 70, and can be selectively rotatable about a pivot axis PA. The axle 70 can include a diameter DIA. As shown in FIGS. 2-4, the pawl 60 is in the form of a hammer shape, having a hammer head 61 and a handle type element 62. The hammer head 61 can include a rounded or curvilinear pawl engagement surface 66. In some cases, the engagement surface can be flat or angled. The engagement surface 66 can extend to a pawl edge 63 that is the last portion of the pawl that the sear 50 engages before the sear 50 is free to rotate and release the bowstring. The engagement surface 66 can be configured so that the sear edge 54 moves and or slides along the engagement surface during a portion of the release cycle of the release. Optionally, although not shown, the pawl edge 63 can include a shoulder between it and the pawl engagement surface 66 so that the sear edge 54 drops into this shoulder after sliding along the curvilinear pawl engagement surface to produce an audible click right before the sear edge disengages the pawl to release the bowstring from the hook sear.

The pawl 60 also can include a reference plane or line RL, which generally extends through and/or is intersected by the pivot axis PA, or the pivot axis can lay in the reference plane. The reference plane RL can be transverse and/or perpendicular to a longitudinal axis LA of the arm 24. The reference plane P can also intersect the engagement surface 66, optionally below the pawl edge 63.

The pawl 60 can further include a pawl clearance surface 67, which can extend above the pawl edge 63 and/or the common axis CA. This clearance surface 67 also can be disposed above the reference plane P. This clearance surface can be rounded or contoured such that when the sear edge 54 disengages the engagement surface and/or the pawl edge 63, that sear edge 54 clears the clearance surface 67 so that the sear swings cleanly and in an uninterrupted manner over it.

The pawl 60 can be mounted to the arm 24 in a preselected configuration according to the preference and sensitivity of the release to the archer. Depending on the precise placement of the engagement surface 66, the sear edge 54 can engage and disengage that engagement surface 66 at the pawl edge 63 thereby allowing the sear 50 to freely rotate about the sear axis 42A, and thereby release the bowstring 100 from the bowstring notch as described in further detail below.

As shown in FIG. 4, the pawl 60 can include the adjuster paddle 80 as mentioned above. This adjuster paddle can form the handle portion 62 of the hammer shape of the pawl. The adjuster paddle 80 can extend downward, below the pivot axis PA of the pawl, about which the pawl is selectively rotatable. The adjuster paddle 80 can include a first portion 80A of a first thickness T1 and a second paddle portion 80B of a second thickness T2 that is less than the first thickness T1. In other cases, the thickness of the adjuster paddle can be uniform, and of the same thickness along the length of the handle portion 62 of the pawl. In yet other cases, the thickness of the adjuster paddle can taper or thin as it extends away from the head 61 of the pawl.

As mentioned above, the pawl 60 can be selectively rotatable about the pivot axis PA, which can be a center axis of the axle 70. The axle 70 can include a diameter DIA. The adjuster paddle can project away from the pivot axis the first distance D1. This distance D1 can be optionally at least 1.5, at least 2.0, at least 2.5, at least 3.0, at least 3.5, at least 4.0, at least 4.5 or at least 5.0 times the diameter DIA, which can provide adequate adjustment and rotation to the pawl using the adjuster elements 91 and/or 92.

The adjuster paddle 80 can further include a first contact surface 81 and an opposing second contact surface 82. These contact surfaces can extend to a tip 80T. The contact surfaces can be generally parallel to one another or can be offset from one another at some angle. These contact surfaces can transition to the optional enlarged first portion 80A of the adjuster paddle, where the adjuster paddle widens to the greater thickness. The contact surfaces can transition at radiused regions if desired. The contact surfaces 81 and 82 can be generally planar as shown, but in other cases can be rounded or of some other contour. The contact surfaces also can extend downward into the recess 26 a preselected distance, and can be disposed between the first wall 28 and the second wall 29, optionally facing those walls respectively.

Optionally, the contact surfaces also can be disposed so that the common axis CA intersects one or both of them. The adjuster paddle and contact surfaces can be offset from the longitudinal axis LA of the arm when the pawl is in most positions by a preselected angle A2. This angle A2 optionally can be an acute angle as shown, or some other angle, depending on the application.

As shown in FIG. 4, the adjuster paddle projects into the recess 26 a preselected distance D4. This distance can be sufficient so that the paddle can be contacted by the one or more adjuster elements 91 and 92. The adjuster paddle can also project a distance D3 above the recess, and in that distance, can be of a thicker thickness T1 because that part of the paddle is above the walls, and therefore not constrained in movement by them. The thinner part of the paddle, however, can fit in the recess, between those walls, and can be moveable a fair degree between the walls in the recess due to the reduced thickness T2.

Referring to FIG. 4, the adjuster elements 91, 92 can lay along the common axis CA and can be disposed in the respective holes 28H and 29H of the walls. The adjuster elements can be in the form of fasteners with threads as shown to thread into the holes. Each of the fasteners can have respective longitudinal axes, which can be coincident with the common axis CA, and optionally transverse to the pivot axis PA. Optionally, the axes of the adjuster elements can be perpendicular to the pivot axis, as can be the common axis CA. These axes also can extend well below the pivot axis, in a skewed manner relative to the axis CA, rather than toward it.

The first adjuster element 91 and second adjuster element 92 can be disposed on opposite sides of the adjuster paddle 80. These adjusters can be positioned so that the first adjuster element 91 directly engages the first contact surface 81 and the second adjuster element 92 directly engages the second contact surface 82. A tip 80T of the adjuster paddle can be disposed below the first and second adjuster elements in the recess 26. Of course, in some applications, the adjuster elements can engage the tip of the paddle, or some other portion of the paddle.

Generally, the first adjuster element 91 and second adjuster element 92 can be adjusted, moved and/or tightened in the respective holes in the walls so that they can exert opposing force vectors F1 and F2 against the adjuster paddle of the pawl, and in particular, against the respective first and second contact surfaces. These force vectors can be generally transverse and optionally perpendicular to the common axis CA and/or the longitudinal axis LA of the arm. The opposing forces can effectively trap and lock the adjuster paddle and thus the pawl in a fixed position relative to the pivot axis PA and/or the arm 24. This in turn can set and secure or fix the angle A1 of the pawl edge relative to the reference plane RL. As explained below, a user can adjust this angle A1 to their particular preference by loosening or backing out one adjuster element and tightening the other adjuster element to clamp the adjuster paddle between the tips of the adjuster elements. These tips 91T and 92T can be flat or chamfered as shown. In other applications, the tips can be rounded or can have other contours. Optionally, however, the tips have a contour that is symmetric about the axes of the adjuster elements so that the tips can rotate smoothly against the respective contact surfaces of the adjuster paddle when altering the angle A1 of the pawl and generally setting the release point of the release.

As mentioned above, an archer can set the release point of the release by selectively adjusting one or both of the adjuster elements to set the pawl edge in a preferred location. As an example, if an archer wants to decrease the angle A1 of the pawl edge relative to the reference plane RL and make the release "hotter", that is, more quick to release when moving the handle during a shot sequence, the archer can loosen adjuster element 91, in which case it backs out of the hole 28H in the wall 28. The user can then tighten the adjuster element 92 so that it moves toward adjuster element 91. As a result, the adjuster element 92 pushes against the paddle adjuster, in particular, the surface 82. As it does so, the paddle adjuster acts as a lever, so that the pawl 60 rotates clockwise about the pivot axis PA, until the first contact surface 81 contacts the first adjuster element 91. When it does so, the first adjuster element and the second adjuster element simultaneously engage the adjuster paddle on opposing surfaces of the adjuster paddle, and exert opposing vector forces F1 and F1 on that paddle. The paddle thus can be clamped in a fixed position between the adjuster elements to set the angle A1 and general position of the pawl and its pawl edge 63. The sear edge 54 thus has less of the engagement surface 66 to ride over until it passes the pawl edge 63.

Where the release includes optional set screws 65 and 68, those can be loosened before the adjustment and retightened after adjustment is completed to further secure the pawl in place. Of course, these set screws can be deleted from the release in most applications due to the holding forces of the adjuster elements.

As another example, if an archer wants to increase the angle A1 of the pawl edge relative to the reference plane RL and make the release "colder", that is, slower to release, with more delay, when moving the handle during a shot sequence, the archer can loosen adjuster element 92, in which case it backs out of the hole 29H in the wall 29. The user also can tighten the adjuster element 91 so that it moves toward adjuster element 92. As a result, the adjuster element 91 pushes against the paddle adjuster, in particular, the surface 81. As it does so the paddle adjuster acts as a lever, so that the pawl 60 rotates counter clockwise about the pivot axis PA, until the second contact surface 82 contacts the second adjuster element 92. When it does so, the first adjuster element and the second adjuster element simultaneously engage the adjuster paddle on opposing surfaces of the adjuster paddle, and exert opposing vector forces F1 and F1 on that paddle. The paddle thus can be clamped in place between the adjuster elements to set the larger angle A1 and general position of the pawl edge 63. The sear edge 54 thus has more of the engagement surface 66 to ride over until it passes the pawl edge 63.

Optionally, the adjuster elements can come in different forms. For example, the fasteners can be replaced with pins, cams, levers or other elements that can selectively exert forces against the adjuster paddle.

The components of the release, for example, the handle, the release head and its parts can be constructed from a variety of materials, for example, metal, such as steel, stainless steel and aluminum, as well as other synthetic materials such as polymers, and any combination of the foregoing. Further, the release 10 and its components can be treated with special processes, for example, anodizing, dipping or filming to provide the release and its components with a desired finish and appearance. In general, components of the release, such as the release head, first adjuster and adjuster linking element can be molded, machined and/or extruded to obtain their desired configuration. These components can also be treated with special processes as described above to provide a desired finish.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

The embodiments of the invention in which an exclusive property or privilege is claimed are defined as follows:

1. An archery release comprising:

a handle including an arm, the arm defining a recess;

a pawl joined with the arm and selectively rotatable about a pivot axis, the pawl including an engagement surface that terminates at a pawl edge, the pawl including a clearance surface disposed across the pawl edge from the engagement surface, the pawl including an adjuster paddle projecting away from the pivot axis a first distance, a sear including a bowstring notch and a sear edge, the sear edge adapted to slidably engage the engagement surface until the sear edge passes the pawl edge; and a first adjuster element projecting info the recess and in engagement with the adjuster paddle to fix an orientation of the pawl relative to the arm of the handle, whereby an archer can set the release point of the release by selectively adjusting the first adjuster element to set the pawl edge in a preferred location.

2. The archery release of claim 1, wherein the adjuster paddle includes a first portion of a first thickness and a second paddle portion of a second thickness, the second thickness being less than the first thickness.

3. The archery release of claim 1, wherein the pawl is joined with the arm via an axle having a diameter, wherein the adjuster paddle projects away from the pivot axis the first distance which is at least twice the diameter.

4. The archery release of claim 1, wherein the adjuster paddle includes a first contact surface and an opposing second contact surface, wherein the first adjuster element directly engages the first contact surface, wherein the first adjuster element is a threaded fastener having an axis that is transverse to the pivot axis.

5. The archery release of claim 1 comprising:

a second adjuster element, wherein the first adjuster element and the second adjuster element are disposed on opposite sides of the adjuster paddle of the pawl, wherein the first adjuster element and second adjuster element exert opposing force vectors against the adjuster paddle of the pawl.

6. The archery release of claim 5, wherein the first adjuster element and second adjuster element are screws, wherein the adjuster paddle includes a first contact surface and an opposing second contact surface, wherein the first adjuster element directly engages the first contact surface, wherein the second adjuster element directly engages the second contact surface, wherein a tip of the adjuster paddle is disposed below the first and second adjuster elements in the recess.

7. The archery release of claim 1, wherein the arm includes a first wall and a second wall below the pivot axis, wherein the first wall defines a first threaded hole and the second wall defines a second threaded hole, the first and second threaded holes laying along a common axis that intersects the adjuster paddle in the recess of the arm.

8. The archery release of claim 7, comprising:

a second adjuster element threaded in the second threaded hole, wherein the first adjuster element is threaded in the first threaded hole, wherein the first adjuster element and the second adjuster element simultaneously engage the adjuster paddle on opposing surfaces of the adjuster paddle.

9. The archery release of claim 1, wherein the sear is rotatably mounted to a hood, wherein the hood is rotatably mounted to the arm.

10. An archery release comprising:

a handle body including an arm;

a pawl joined with the arm, the pawl including a pawl edge adjacent a curvilinear engagement surface and a paddle distal from the pawl edge, the pawl selectively rotatable about a pivot axis;

a hood joined with the arm via a first axle;

a sear including a bowstring notch and a sear edge, the sear edge adapted to slidably engage the curvilinear engagement surface, the sear joined with the hood; and an adjuster element configured to engage the paddle and set the pawl edge at a fixed angle relative to a reference plane extending through the pivot axis.

11. The archery release of claim 10, wherein the pawl edge lays between the curvilinear contact surface and a clearance surface, wherein the clearance surface is disposed on an opposite side of a reference plane passing through the pivot axis from the paddle.

12. The archery release of claim 10, wherein the pawl defines a pawl axle hole having a diameter, wherein the paddle extends a first distance away from the pivot axis, wherein the ratio of the first distance to the diameter is at least 2:1.

13. The archery release of claim 10, wherein the arm includes a first wall and a second wall, wherein the first adjuster element extends through the first wall, wherein the second adjuster element extends through the second wall.

14. The archery release of claim 13, wherein the first adjuster element and the second adjuster element lay along a common axis that is perpendicular to the pivot axis.

15. The archery release of claim 10, wherein the first adjuster element engages the paddle in a direction transverse from which a second adjuster element engages the paddle, wherein the first adjuster element and the second adjuster element lay along a common axis that is perpendicular to the pivot axis.

16. The archery release of claim 10, wherein the paddle is an elongated arm that has a thickness that is less than one half of a diameter of an axle about which the pawl is selectively rotatable.

17. An archery release comprising:

a handle body including an arm;

a pawl joined with the arm including an engagement surface and a pivot axis;

a hood rotatably joined with the arm via a first axle; and a sear including a bowstring notch and a sear edge, the sear edge adapted to slidably engage the engagement surface of the pawl, the sear joined with the hood;

wherein the pawl includes an adjuster paddle distal from an engagement surface that extends away from a pivot axis, wherein a first adjuster element extends through a portion of the arm and maintains the pawl in a fixed relationship relative to the arm, wherein the first adjuster element includes an adjuster longitudinal axis that is generally perpendicular to the pivot axis.

18. The archery release of claim 17, wherein the first adjuster element engages the adjuster paddle in a direction generally opposite from which a second adjuster element engages the adjuster paddle, wherein the first adjuster element and the second adjuster element lay along a common axis that is perpendicular to the pivot axis.

19. The archery release of claim 17, wherein the pawl defines a pawl axle hole having a diameter, wherein the adjuster paddle extends a first distance away from the pivot axis, wherein the ratio of the first distance to the diameter is at least 2:1.

20. The archery release of claim 17 comprising:

a second adjuster element joined with the arm, wherein the first adjuster element and the second adjuster element simultaneously engage the adjuster paddle on opposing surfaces of the adjuster paddle.

* * * * *